United States Patent [19]

Oude Aarninkhof

[11] 4,183,598

[45] Jan. 15, 1980

[54] CONTACT DEVICE FOR THE TRANSMISSION OF ELECTRIC CURRENT BETWEEN A STATIONARY CONTACT PART AND A MOVABLE CONTACT PART

[75] Inventor: Martinus A. Oude Aarninkhof, Almelo, Netherlands

[73] Assignee: Hazemeijer B.V., Hengelo, Netherlands

[21] Appl. No.: 870,734

[22] Filed: Jan. 19, 1978

[30] Foreign Application Priority Data

Jan. 21, 1977 [NL] Netherlands ..... 7700648

[51] Int. Cl.[2] ..... H01R 39/00

[52] U.S. Cl. ..... 339/6 R; 308/6 B; 339/252 R

[58] Field of Search ..... 339/6 R, 9 R, 5 S, 2 RL, 339/252 R, 254 R; 308/6 R, 6 B

[56] References Cited

U.S. PATENT DOCUMENTS 2,483,419 10/1949 Karmin ..... 339/9 R 3,003,827 10/1961 Hentschke ..... 308/6 B 3,259,727 7/1966 Casler ..... 339/2 RL X

*Primary Examiner*—Roy Lake

*Assistant Examiner*—DeWalden W. Jones

*Attorney, Agent, or Firm*—Watson, Cole, Grindle & Watson

[57] ABSTRACT

In a contact device for the transmission of electric current between a stationary contact and a movable contact wherein the stationary contact has walls at least partially encircling the movable contact, resilient elements transmit the current and are positioned between the movable contact and the walls of the stationary contact. The resilient elements comprise roller contact springs made of a material having sufficient electrical conductivity, elasticity and mechanical strength and are wedged in between the movable contact such that upon movement thereof the contact springs revolve about their center. The springs have a diameter larger than is necessary to span the distance between the movable contact and the walls of the stationary contact, and the roller contact springs are reduced in diameter by twisting or torsioning.

10 Claims, 8 Drawing Figures

CONTACT DEVICE FOR THE TRANSMISSION OF ELECTRIC CURRENT BETWEEN A STATIONARY CONTACT PART AND A MOVABLE CONTACT PART

The invention relates to a contact device for the transmission of electric current between a stationary contact part and an oblong movable contact part, in which the stationary contact part has walls at least partially encircling the movable contact part, whereas resilient elements for the transmission of current are situated between the movable contact part and the walls of the stationary contact part.

A similar contact device is known from the German "Auslegeschrift" 1,040,653. Here, the resilient elements for the transmission of current consist of rollers which are mounted in pairs between the sleeve-shaped stationary contact part and the pin-shaped movable contact part, a sufficient contact pressure of the surfaces of the rollers on the surface of the movable contact part and the inner wall of the sleeve being provided with the aid of either compression springs or tension springs between two rollers at a time.

A such contact device has the advantage that, when displacing the movable contact, there will be only a very slight frictional resistance since merely a rolling friction will occur. However, this known device is extremely complicated and comparatively costly and, moreover, suitable only for reciprocating motions of the movable contact part.

The object of the present invention is to provide a device of the type as mentioned above which, while preserving the advantage of the slight roller friction, is suitable both for reciprocating and for rotational contact transmitting motions and, moreover, is of a most simple construction while its parts are not committed to accurate tolerances for a correct transmission of current.

The contact device according to the invention is characterized in that the resilient elements consist of roller contact springs made of a material having sufficient electric conductivity, elasticity and mechanical strength, said roller contact springs being wedged in between the movable contact part and the walls of the stationary contact part and, when not wedged in, having a diameter larger than is necessary to span the distance between the movable contact part and the walls of the stationary contact part.

The roller contact springs may consist of resilient spheres, in which case the movable contact can simultaneously carry out a translation displacement and a rotational displacement, but also of helical springs, in which case the movable contact can carry our either a translation displacement or a rotational displacement.

The assembly of the contact device according to the invention is particularly simple. Compression of the resilient spheres to create the correct contact pressure is realized when the movable contact part is introduced into the stationary contact part. Before the helical springs are put in position between the stationary contact part and the movable contact part, their diameter may be reduced as a result of twisting together or of torsioning. Due to the resilient effect, the correct contact pressure is then automatically realized.

According to a first embodiment, the stationary contact part consists of a sleeve which is partly closed at at least one extremity or fitted with an inward flange and having a round central opening in said extremity, through which opening the movable contact with corresponding round cross section is passed. This embodiment is particularly suitable for the use of the roller contact springs consisting of resilient spheres.

When applying helical springs, embodiments will also be possible in which the stationary contact part consists of a sleeve closed at at least one extremity or fitted with an inward flange and having a round central opening in said extremity, through which opening the movable contact with corresponding round cross section is passed. Here, the helical springs may be placed round the movable contact like a collar in the space between said movable contact and the walls of the sleeve. Also, more helical springs may be wedged in between the movable contact part and the wall of the sleeve, their longitudinal direction being parallel to the longitudinal direction of the movable contact part, in which case the movable contact part may rotate with respect to the stationary contact part.

With a further embodiment of the invention, the stationary contact part is U-shaped whereas the movable contact part can be displaced longitudinally between the legs of the U and perpendicularly to the plane of the U, the U-shape having a wall at least on one side, which wall is also situated perpendicularly to the surface of the U, said wall having a rectangular opening through which the movable contact with corresponding rectangular cross section is passed. According to the invention, on either side of the movable contact part, two or more roller contact springs are wedged in between the movable contact and the walls formed by the legs of the U-shaped stationary contact.

In the cases as stated above, the contact pressure is dependent upon the difference between the diameter of the roller contact spring and the distance between both contact parts, as a result of which the contact pressure is also determined by the choice of the size of the diameter of the roller contact springs.

Even after prolonged intensive use, a good contact pressure is maintained with the contact device according to the invention. Dependent upon the thickness, the section and the material of the roller contact springs, as well as upon the number of roller contact springs and the length of the helical springs, the device according to the invention is suitable for transmission of current intensities ranging from low to very high. Since various roller contact springs may be used along with each other, a considerable variety in current range may yet be realized with comparatively simple means.

The cross section of the material from which the helical springs are wound will be preferably rectangular since, in this manner, the largest possible contact surface with both the movable and the stationary contact part will be acquired. However, other sections will also be possible, e.g. a rectangular section with rounded-off lateral surfaces facing each other.

With the contact device according to the present invention, the roller contact springs perform the function of balls or rollers in ball bearings and roller bearings respectively, whereas the movable and the stationary contact parts function as a shaft with an inner and an outer ring respectively.

The invention will now be further elucidated with the aid of the drawings in which exemplary embodiments are shown.

Figure 1:
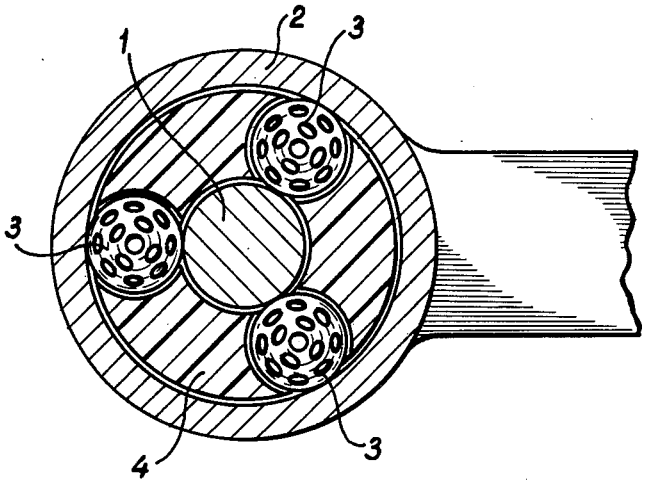
FIG. 1 shows a cross section of a first embodiment of a contact device according to the invention, in which the movable contact part has a round cross section and in which the displacement can be both a translation displacement and a rotational displacement.
Figure 2:
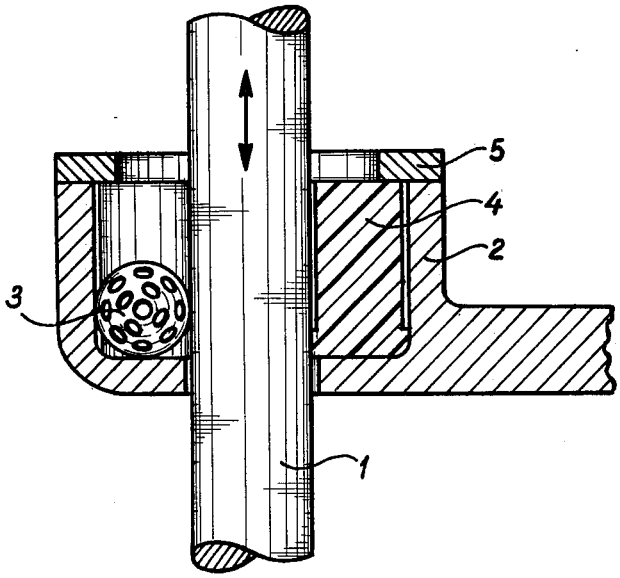
FIG. 2 shows a longitudinal section of the contact device according to FIG. 1.

FIG. 1 shows a cross section of a first embodiment, in which the movable contact part 1 may carry out both a translation displacement and a rotational displacement. The movable contact part 1 extends axially through a stationary contact part 2 in the form of a sleeve having, both in the base and in the cover 5 (see FIG. 2) a round opening to allow the movable contact part 1 to pass through. These openings are axially in line with each other and may serve to guide said mobile contact part.

The roller contact springs consist of resilient hollow spheres or balls 3. For instance, these may consist of two hollow half spheres welded together and made of electrically conductive and sufficiently resilient thin sheet material. The spheres thus obtained may be provided with appropriate grooves or openings in the walls, as a result of which their resilient effect may be improved, if necessary. If the current intensity permits, spheres of electrically conductive hard rubber or electrically conductive plastic may also be applied.

The resilient spheres are kept divided round the movable contact part with the aid of appropriate spacers 4, preferably of electrically insulating material, which are customary with ball bearings and roller bearings. Before the movable contact part 1 is put in position, the spheres can be introduced into the sleeve 2, after which the movable contact part is inserted and the spheres are compressed over a short distance.

Figure 3:
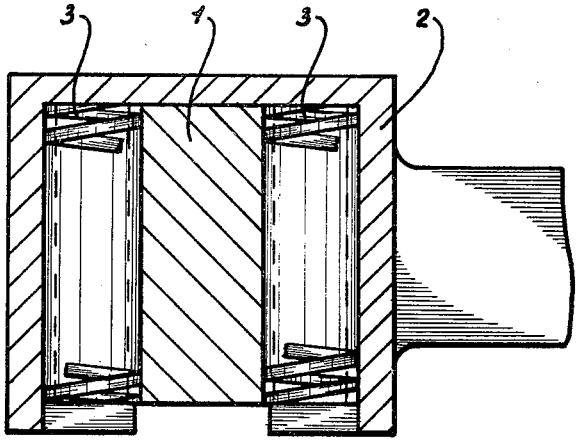
FIG. 3 shows a cross section of an exemplary embodiment, in which the movable contact part has a rectangular section and the contact motion is rectilinear.

As appears from FIG. 3, the movable contact part has a rectangular section and can move up and down in a straight line through a likewise rectangular recess in the base of the stationary contact part 2. Said stationary contact part 2, having a U-shape closed on one side, and the movable contact 1 may be incorporated in an electric circuit with the aid of suitable means known per se which, for the sake of clearness, is not shown here.

On either side of the movable contact part 1, the roller contact springs 3 in the form of helical springs are mounted with their longitudinal axis perpendicular to the direction of motion, between said movable contact part 1 and the upstanding legs of the U-shaped contact part 2.

Since the roller contact springs 3 have a diameter exceeding the distance between the movable contact part 1 and the stationary contact part 2, said roller contact springs 3 will touch these two contact parts under a certain pressure due to the spring tension.

Besides the required contact pressure, it is also achieved by this spring tension that the dimensions of the parts need not conform to very accurate tolerances and will yet guarantee a good contact which will be the case even in case of wear, if any.

Figure 4:
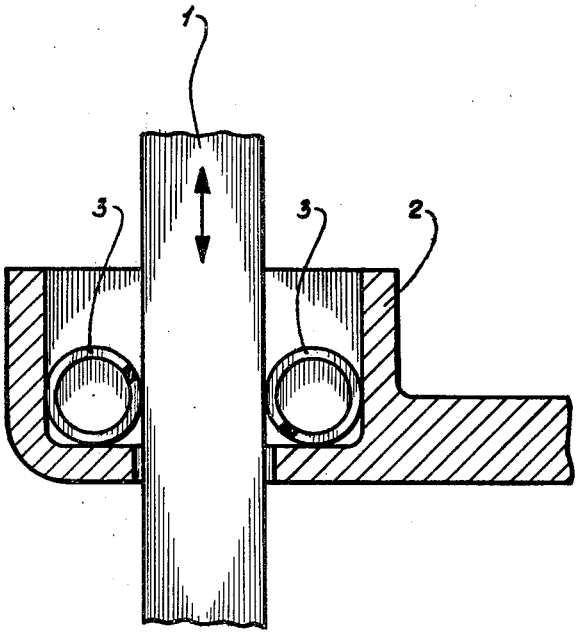
FIG. 4 shows a longitudinal section of the contact device according to FIG. 3.

During the upward and downward motions of the movable contact part 1 (see FIG. 4) the roller contact springs 3 will roll in the same direction along the stationary contact part 2, as a result of which both contact parts will continuously be in contact with each other via the roller contact springs 3. As a matter of course the legs of the U should have a height seen in the direction of the displacement, matching the prospective displacement of the movable contact part.

It will be clear that, instead of the two roller contact springs 3 indicated here, more roller contact springs may also be applied, so that the device can be made suitable for superior current intensities and a more stable mechanical build-up may be realized.

Figure 5:
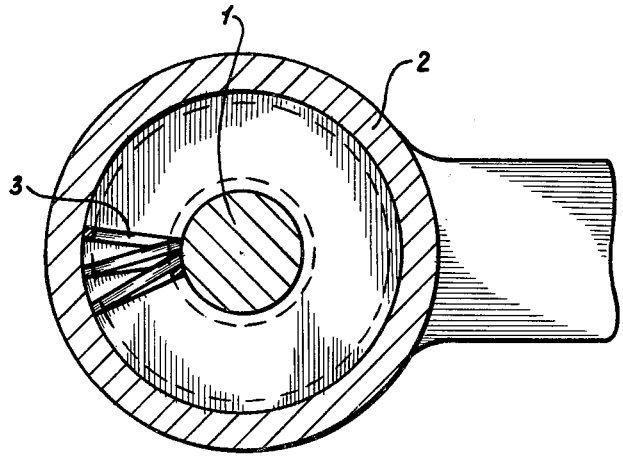
FIG. 5 shows a cross section of a third exemplary embodiment of a contact device according to the invention, in which the movable contact part has a round section and the contact motion is likewise rectilinear.
Figure 6:
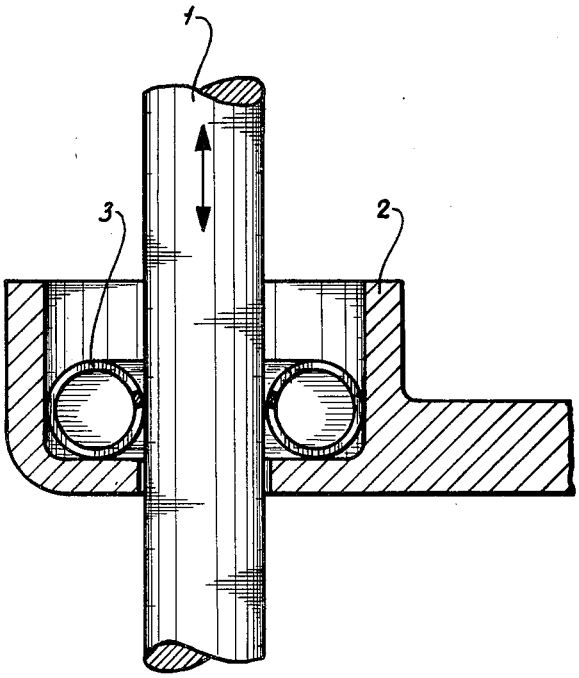
FIG. 6 shows a longitudinal section of the exemplary embodiment according to FIG. 5.

FIGS. 5 and 6 show an exemplary embodiment in which the mobile contact part has a round section and in which a rectilinear displacement will likewise be possible. Here, the stationary contact part 2 is executed in the form of a sleeve having in its base a transit opening through which the movable contact part 1 can move up and down in a straight line. The roller contact springs 3 is closed in upon itself and, therefore, has the shape of a torus and, in its turn, is confined within the space between the movable contact part 1 and the stationary contact part 2, the diameter of the roller contact spring 3, here too, being made to exceed the distance between the movable contact part 1 and the sleeve walls of the stationary contact part 2 so that the contact pressure is thus determined.

Figure 7:
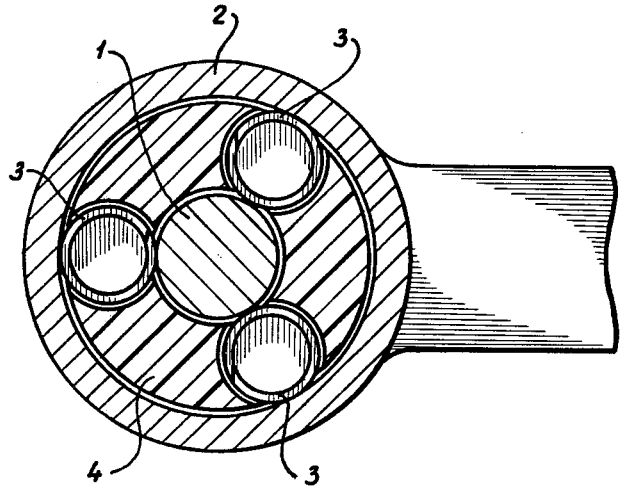
FIG. 7 shows a fourth exemplary embodiment of a contact device according to the invention in cross section, in which the contact motion is rotational.
Figure 8:
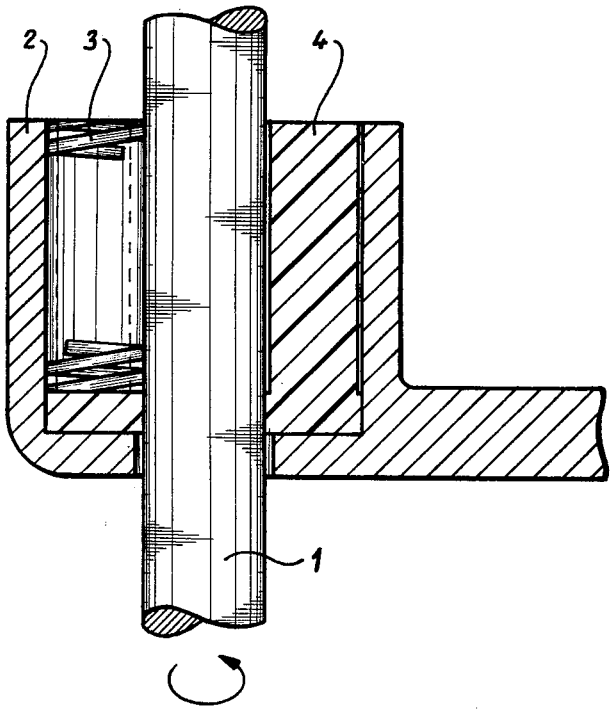
FIG. 8 shows a longitudinal section of the contact device according to FIG. 7.

FIG. 7 shows an example of application of the invention with a rotating contact device. Here, too, the stationary contact part 2 has the form of a sleeve with an opening in the base to allow the movable contact part 1 to pass through. The roller contact spings 3 are again placed between the stationary contact part 2 and the walls of the movable contact part 1, the correct contact pressure being provided in the manner already described above. Moreover, the roller contact springs 3 are mounted in such a manner that their longitudinal axis will run parallel to the axis of the movable contact part 1 so that, in its turn, the direction of motion will be perpendicular to said longitudinal axis, whereas a spacer 4, preferably of insulating material, will see to it that the roller contact springs 3 will remain regularly divided in the space between the movable contact part 1 and the stationary contact part 2. In this manner, a contact device is obtained, comparable to a roller bearing and having a minimal frictional resistance and a good contact transmission. Naturally, here again, the number of roller contact springs may be increased in order to be able to transmit superior current intensities.

It will be understood that the invention is not restricted to the embodiments shown in the drawings and discussed above but that it will be possible to make additions and modifications without exceeding the scope of the invention.

I claim:

1. Contact device for the transmission of electric current between a stationary contact part and an oblong movable contact part, in which the stationary contact part has walls at least partially encircling the movable contact part, comprising resilient elements for the transmission of current situated between the movable contact part and the walls of the stationary contact part, said resilient elements are roller contact springs made of a material with sufficient electric conductivity, elasticity and mechanical strength, said roller contact springs being wedged in between the movable contact part such that upon movement of the movable contact part said contact springs revolve about their center and said springs having a diameter larger than is necessary to span the distance between the movable contact part and the walls of the stationary contact part, said roller contact springs are reduced in diameter by twisting or torsioning.

2. Contact device according to claim 1, wherein said roller contact springs consist of resilient spheres, and the movable contact part may carry out both a translation displacement and a rotational displacement with respect to the stationary contact part.

3. Contact device according to claim 1, wherein said roller contact springs consist of helical springs.

4. Contact device according to claim 1, wherein said stationary contact part consists of a sleeve which is provided, at least at one extremity, with an inward flange so that a round central opening is formed in said extremity, through which opening the movable contact having a corresponding round cross section is passed.

5. Contact device according to claim 1 wherein said stationary contact part is U-shaped and the movable contact part can be displaced longitudinally between the legs of the U and perpendicularly to the surface of the U, the U-shape having a wall at least on one side, which wall is also situated perpendicularly to the surface of the U, said wall having a rectangular opening, through which the movable contact part with corresponding rectangular cross section is passed, two or more roller contact springs being wedged in on either side of the movable contact part, between the movable contact part and the walls formed by the legs of the U-shaped stationary contact part.

6. Contact device according to claim 1 wherein said stationary contact part consists of a sleeve which is provided, at least at one extremity, with an inward flange so that a round central opening is formed in said extremity, through which opening the movable contact part with corresponding round cross section is passed and that, between the movable contact part and the side walls of the sleeve, one or more helical springs closed in upon themselves are situated around the movable contact like a collar.

7. Contact device according to claim 1 wherein said stationary contact part consists of a sleeve which is provided, at least at one extremity, with an inward flange so that a round central opening is formed in said extremity, through which opening the movable contact with corresponding round cross section is passed and that, between the movable contact and the side walls of the sleeve, at least three roller contact springs are wedged in with their longitudinal axis running parallel to the longitudinal direction of the movable contact, said roller contact springs being kept divided around the movable contact by means of spacers which are likewise situated in the space between the movable contact part and the side walls of the sleeve.

8. Contact device according to claim 1 wherein said roller contact springs are wound from wire having a rectangular cross section.

9. Contact device according to claim 1 wherein said roller contact springs are wound from wire having a rectangular cross section rounded off at two sides facing each other.

10. Contact device according to claim 2, wherein said resilient spheres consist of two half-spheres joined together and provided with appropriate grooves to obtain the correct resilient effect.

* * * * *